US006299411B1

(12) United States Patent
Freuschle et al.

(10) Patent No.: US 6,299,411 B1
(45) Date of Patent: Oct. 9, 2001

(54) FASTENING OF MOVING BLADES OF A FLUID-FLOW MACHINE

(75) Inventors: Dieter Freuschle; Siegfried Hohmann, both of Waldshut (DE)

(73) Assignee: ABB Alstom Power (Schweiz) AG, Baden (CH)

( * ) Notice: Subject to any disclaimer, the term of this patent is extended or adjusted under 35 U.S.C. 154(b) by 0 days.

(21) Appl. No.: 09/501,998

(22) Filed: Feb. 11, 2000

(30) Foreign Application Priority Data

Feb. 12, 1999 (EP) ..... 99810127

(51) Int. Cl.[7] ..... F04D 29/34
(52) U.S. Cl. ..... 416/215
(58) Field of Search ..... 416/178, 193 A, 416/215, 216, 217, 218, 222; 29/889.21

(56) References Cited

U.S. PATENT DOCUMENTS

| | | | | |
|---|---|---|---|---|
| 1,008,758 | * | 11/1911 | Warren | 416/215 |
| 1,010,630 | * | 12/1911 | Hodgkinson | 416/215 |
| 1,156,529 | * | 10/1915 | Hillner | 416/215 |
| 1,371,327 | * | 3/1921 | Schneider | 416/215 |
| 1,476,626 | * | 12/1923 | Losel | 416/215 |
| 1,590,328 | * | 6/1926 | Snyder | 416/215 |
| 2,281,318 | * | 4/1942 | Neufeld | 416/215 |
| 2,315,616 | * | 4/1943 | Hall | 416/217 |
| 2,857,134 | * | 10/1958 | Arkless | 416/216 |
| 2,916,257 | * | 12/1959 | Poellmitz et al. | 416/215 X |
| 3,328,867 | | 7/1967 | Guengant | 29/889.21 |
| 3,826,592 | * | 7/1974 | Raboin | 416/222 |
| 4,702,673 | * | 10/1987 | Hansen et al. | 416/215 |
| 4,730,984 | * | 3/1988 | Ortolano | 416/222 |
| 5,737,816 | | 4/1998 | Hartmann et al. . | |

FOREIGN PATENT DOCUMENTS

| | | | | |
|---|---|---|---|---|
| 322 010 | | 5/1957 | (CH) . | |
| 214787 | * | 3/1909 | (DE) | 416/215 |
| 436567 | * | 11/1926 | (DE) | 416/215 |
| 724549 | * | 8/1942 | (DE) | 416/215 |
| 44 36 731 | | 4/1996 | (DE) . | |
| 195 20 274 | | 12/1996 | (DE) . | |
| 196 54 471 | | 7/1998 | (DE) . | |
| 363 064 | | 7/1906 | (FR) . | |
| 639320 | * | 6/1950 | (GB) | 416/215 |
| 720802 | | 12/1954 | (GB) . | |
| 2169664-A | * | 7/1986 | (GB) | 416/215 |

* cited by examiner

*Primary Examiner*—John E. Ryznic
(74) *Attorney, Agent, or Firm*—Burns, Doane, Swecker & Mathis, L.L.P.

(57) ABSTRACT

Moving blades of a fluid-flow machine are fastened in a circumferential slot on the rotor by means of blade roots. For the installation of the last moving blade, a gap is provided between the first and penultimate blade. After the latter has been fitted, a residual gap remains in the circumferential slot, and this residual gap is filled by means of whole intermediate pieces and halved intermediate pieces (7*a*, 7*b*), which are arranged between the moving-blade roots. According to the invention, the inner sides (8) of the halved intermediate pieces (7*a*, 7*b*), which inner sides (8) face the center of the circumferential slot, are of hook-shaped design. In this case, the inner side (8) of one half (7*a*) of a halved intermediate piece forms the geometric negative of the inner side (8) of the other half (7*b*) of the halved intermediate piece. As a result, the two halves (7*a*, 7*b*) can be connected to one another in a positive-locking manner. Axial forces which act on the side walls of the circumferential slot are reduced by this connection, so that the cross section of the halved intermediate pieces (7*a*, 7*b*) can be produced in a rectangular form and consequently more cost-effectively.

6 Claims, 3 Drawing Sheets

Fig. 3a

FASTENING OF MOVING BLADES OF A FLUID-FLOW MACHINE

FIELD OF THE INVENTION

The invention relates to fastening of turbine moving blades in a circumferential slot on the turbine rotor.

BACKGROUND OF THE INVENTION

Fastening of moving blades in turbine rotors by anchoring blade roots in a circumferential slot is known. Such fastening is used in particular in the case of smaller blades. The blade roots, in their horizontal cross section perpendicular to the blade longitudinal axis, usually have a basic rhombic shape and, in their longitudinal axis, basically have the shape of an inverted T or a hammer-head shape, which engages in serrations in the slot. In this case, the short sides, of a rhombus or axial guide surfaces, are bearing against the side walls of the slot.

During the fitting of blades in circumferential slots in the rotor, the problem of fitting the last blade of a blade row arises in each case. A known method is to ensure that there is a fitting gap, which is dimensioned in such a way that the last blade root can only just be inserted into the slot. If the blade root has a basic rhombic shape, the fitting gap needs to be at least equal to the long diagonal of the rhombus, as shown in FIG. 1*a* and explained in more detail below. After the last blade has been inserted and rotated into the desired orientation, a residual gap remains between the first blade and the last (nth) blade. To fix the blades in the slot and to avoid displacements of the blades during operation, this residual gap is filled by means of intermediate pieces or distancing inserts which are arranged between the blade roots, as shown in FIGS. 1*b* and *c* and explained in more detail below. FIGS. 2*a* and *b* show individual intermediate pieces, some of which are whole intermediate pieces and others are halved intermediate pieces. In the case of the halved intermediate pieces, the sides bearing against one another in the center are straight and vertical. The intermediate pieces or distancing inserts serve not only to fix the blade roots in the slot but also to keep the blade roots at a distance from one another and to uniformly distribute the residual gap over the circumference of the slot.

The intermediate pieces in each case have the same shape as the blade roots which fix them. The blade roots of each blade row are in each case dimensioned in accordance with the size of the blades of that blade row. In this case, the blade roots of one blade row differ from those of a further blade row in their width, their length and the number of serrations and steps in the T-shape or hammer-head shape.

During the fitting of the last intermediate piece, the same problem as with the fitting of the last blade again appears. To solve this problem, the presence of a gap which is large enough for fitting a halved intermediate piece is again ensured. Finally, this smaller gap is filled by means of halved intermediate pieces, as shown in FIG. 2*b*. (the gap which still remains at the end after insertion of these halved intermediate pieces is finally filled by a three-piece closing piece, whereupon the blades are sufficiently fixed in the circumferential slot for the operation of the turbine.)

The basic shape, or the cross section, of the whole intermediate pieces described here is rectangular, i.e. the short sides of the intermediate piece, or axial guide surfaces, lie at an angle to the side wall of the circumferential slot. The intermediate pieces therefore touch the side wall of the slot only with their corners. However, the slot and the intermediate pieces are not greatly loaded as a result, since the lateral axial force on the whole intermediate pieces is only very small.

In the fitting region, the halved intermediate pieces have a rhombic cross section, the short sides of the rhombus being at an angle to the long sides which is different from 90°. The angle is dimensioned in such a way that the short sides, or axial guide surfaces, bear flat against the side wall of the circumferential slot. Flat bearing is necessary since the lateral axial forces which act on the halved intermediate piece are much greater compared with the whole intermediate pieces. If the short sides did not bear flat against the side walls of the slot, the halved intermediate pieces would cut a notch in the side wall and damage the latter.

The difference between the axial forces on the halved intermediate pieces and the axial forces on the whole intermediate pieces is connected with the fact that there is one center of gravity in the case of the whole intermediate pieces and there are two centers of gravity, on which the centrifugal force acts, in the case of the halved intermediate pieces.

The angled configuration of the short sides of the halved intermediate pieces avoids damage to the intermediate pieces and the slot by notching. However, the production of the angled configuration is expensive.

SUMMARY OF THE INVENTION

The object of the invention, for the fastening described at the beginning of moving blades in a circumferential slot, is to provide halved intermediate pieces which can be produced more cost-effectively compared with the prior art mentioned here.

This object is achieved by moving-blade fastening, in which, when viewing the vertical cross section parallel to the long side of the basic shapes those sides of the halved intermediate pieces which face the center of the circumferential slot and the adjacent halved intermediate piece are of hook-shaped design. In this case, the hook shape of the one halved intermediate piece forms the geometric negative of the hook shape of the adjacent halved intermediate piece, so that the sides of the two halved intermediate pieces fit into one another and can be interlinked in a positive locking manner on account of their hook shape. The two intermediate pieces are thus to be regarded as geometric counterparts of one another. The basic shape or the horizontal cross section of the halved intermediate pieces interlinked according to the invention is of right-angled design.

The interlinking of adjacent, halved intermediate pieces, situated beside each other, by the hook shape according to the invention has the advantage that the two halved intermediate pieces are now connected to form a single piece having a single center of gravity. An intermediate piece is obtained which, with regard to the forces which act thereon, is equivalent to a whole intermediate piece, on which only small axial forces act. Those axial forces which act on the individual halved intermediate pieces now act on the hook-shaped inner surfaces of the intermediate pieces. The side surfaces of the intermediate pieces, which side surfaces touch the side walls of the slot, are thereby relieved. This enables the short side walls of the intermediate pieces to be produced at right angles. Since the axial forces are now smaller, notching at the slot wall does not occur. The invention thus results in the advantage that the halved intermediate pieces can also be produced at right angles and cost-effectively. The hook-shaped inner surfaces, according to the invention, of the halved intermediate pieces are produced, for example, by a laser cutting process.

DESCRIPTION OF THE DRAWINGS

A preferred embodiment of the invention is illustrated in the accompanying drawings, in which.

DETAILED DESCRIPTION OF THE INVENTION

Figure 1A:
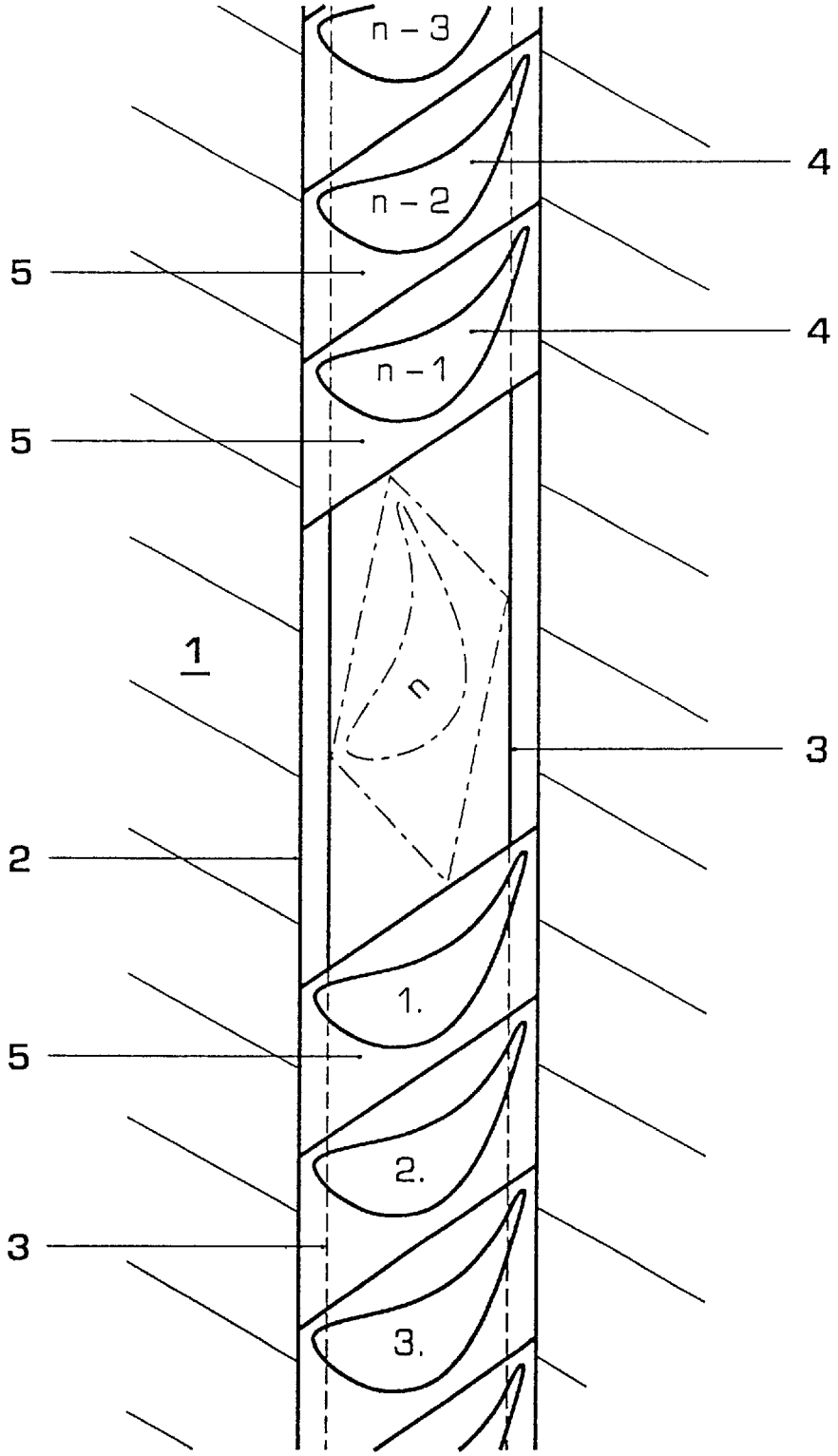
FIG. 1*a* shows a circumferential slot on a rotor having n−1 fitted moving blades and a fitting gap for the last, nth blade according to the prior art.
Figure 1B:
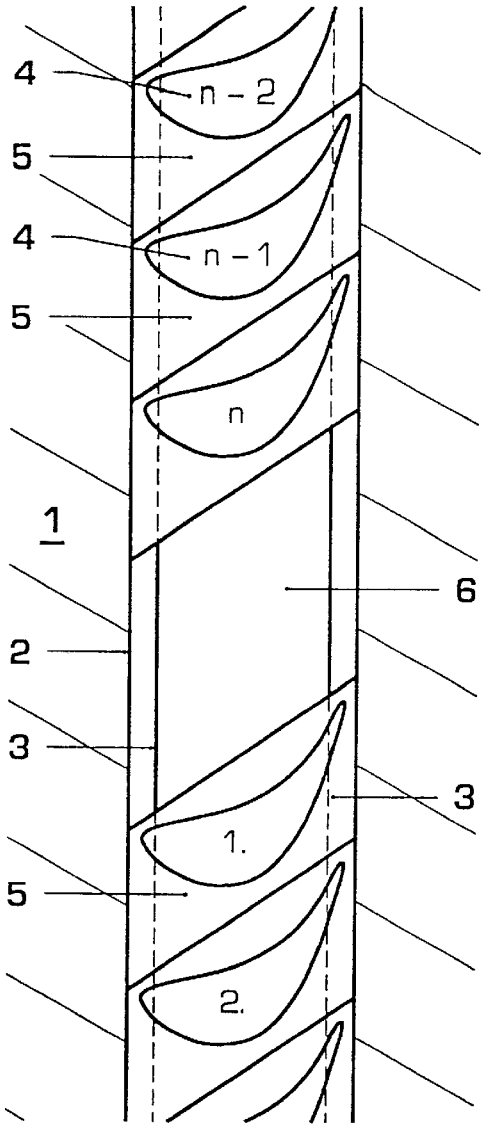
FIG. 1*b* shows the same circumferential slot having n fitted moving blades and the residual gap left according to the prior art.

FIG. 1*a* shows a rotor 1 in which a circumferential slot 2 with slot serrations 3 is arranged. Moving blades 4, which are identified by 1st, 2nd, etc., up to n−1 and n, are inserted in the circumferential slot 2. The roots 5 of the moving lades 3 have a basic rhombic shape, which is adapted to the width of the circumferential slot, so that the sides of the blade roots 5 rest flat against the sides of the slot. In their cross section, the blade roots are basically T-shaped, as a result of which they can be anchored in the slot serrations 3. Furthermore, the rhombuses of the blade roots, in their length in the circumferential direction, are dimensioned in such a way that a gap, which is equal to the long diagonal of a blade-root rhombus, remains after n−1 moving-blade roots have been anchored in the slot. This gap therefore ensures the fitting of the last, nth blade without a lateral installation opening. After the last blade has been fitted, a residual gap 6 remains as shown in FIG. 1*b*.

Figure 1C:
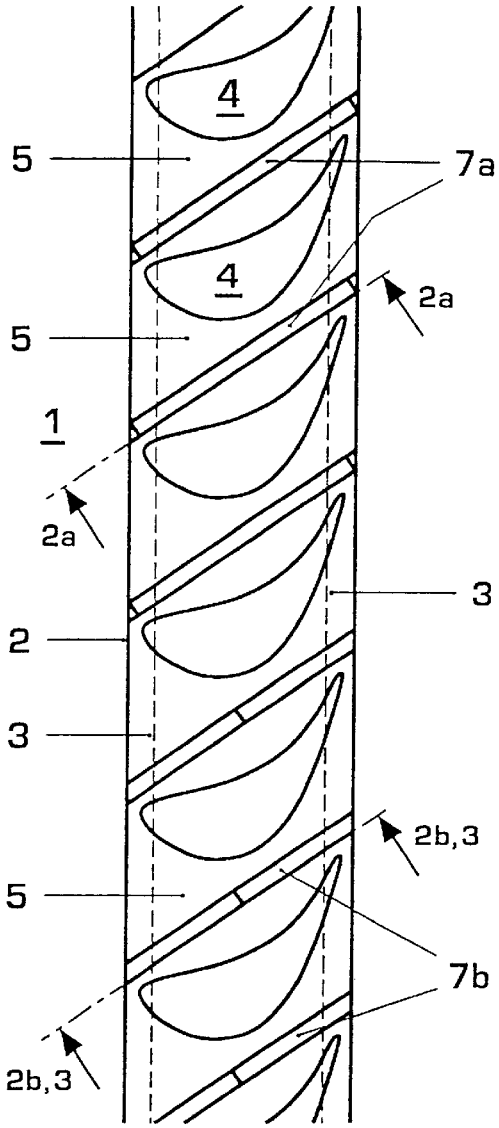
FIG. 1*c* shows the same circumferential slot having n fitted moving blades and n inserted intermediate pieces according to the prior art.
Figure 2B:
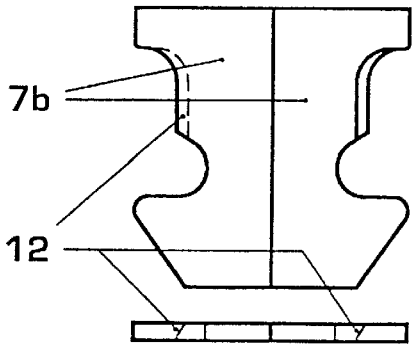
FIG. 2*b* shows a vertical elevation of a halved intermediate piece corresponding to the cross-section 2*b*—2*b* in FIG. 1C according to the prior art.
Figure 2A:
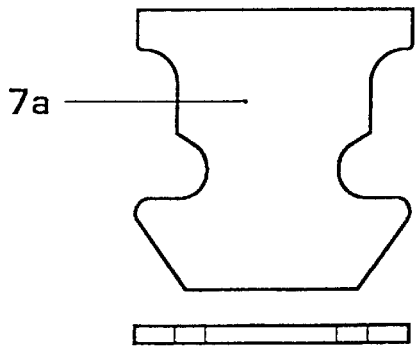
FIG. 2*a* shows a vertical elevation of an intermediate piece corresponding to the cross-section 2*a*—2*a* in FIG. 1C according to the prior art.

FIG. 1*c* shows the filling of the residual gap 6 by means of distancing inserts or intermediate pieces 7*a*, 7*b*. The latter are inserted between the blade roots and are anchored in the slot serrations 3 in the same way as the blade roots themselves. To this end, the intermediate pieces 7*a*, 7*b* are designed to have the same shape as the blade roots which fix them. Most of the intermediate pieces are so-called whole intermediate pieces 7*a* as shown in FIG. 2*a*, the remaining intermediate pieces are halved intermediate pieces 7*b* as shown in FIG. 2*b*. First of all the whole intermediate pieces are inserted. The halved intermediate pieces 7*b* are used when the gap has become too narrow for the installation of the whole intermediate pieces. Finally, after the halved pieces have been installed, a small gap remains and is closed with a closing piece, so that the blades are fixed in the slot in a virtually seamless manner.

Figure 3A:
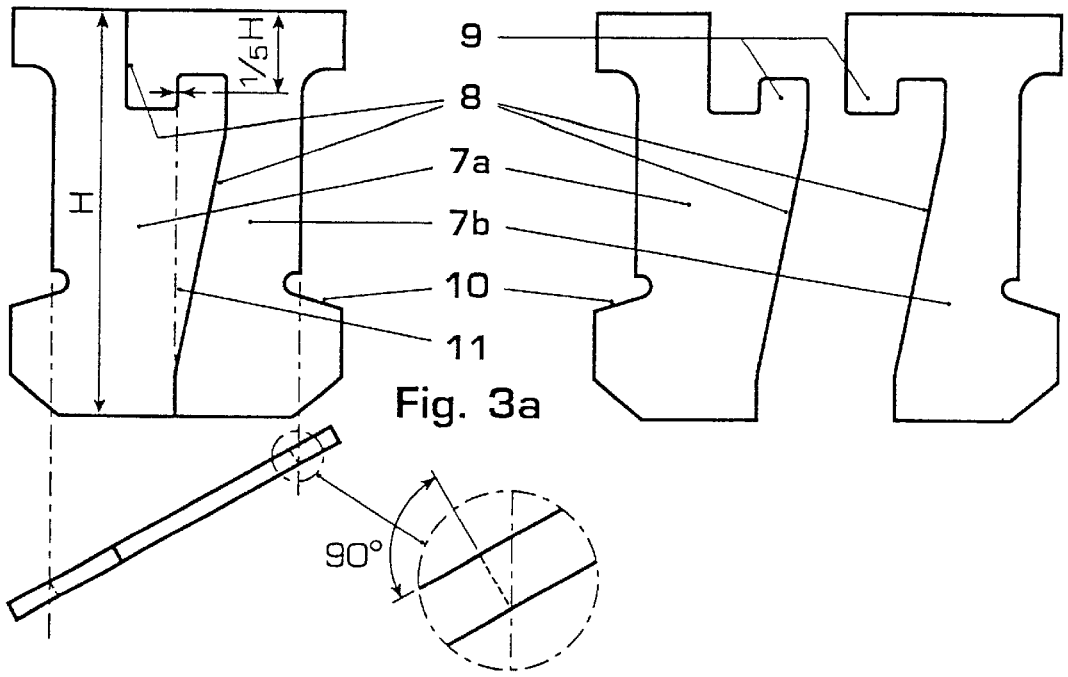
FIGS. 3*a*, 3*b* and 3*c* show various modifications of the halved intermediate pieces according to the invention, with interlinked inner surfaces.
Figure 3B:
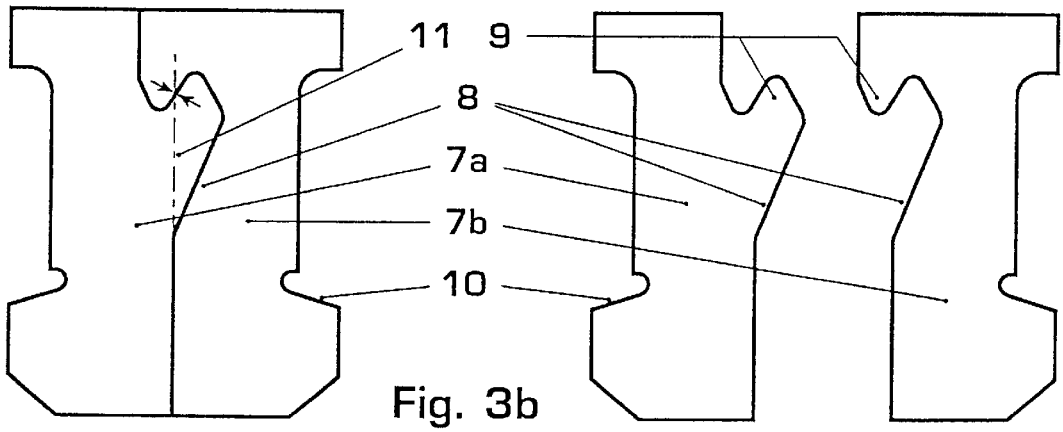
Figure 3C:
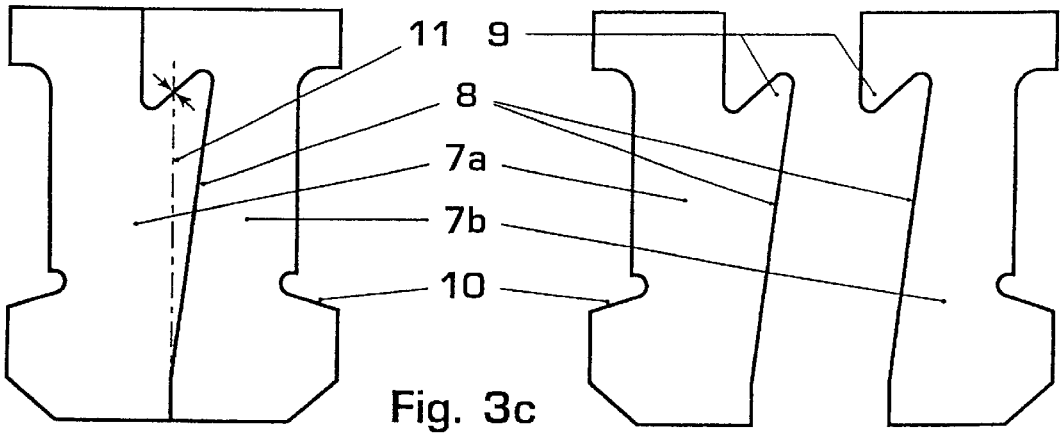

FIGS. 3*a* to *c* show several variants of halved intermediate pieces 7*a* and 7*b* which are shaped and interlinked according to the invention. The hook shape 9, according to the invention, of the inner sides 8 of the intermediate pieces is of right-angled design in a first embodiment, as in FIG. 3*a*. In this case, the half piece 7*a* is the geometric negative of the half piece 7*b*, so that the two half pieces fit into one another in a positive-locking manner as shown and can be interlinked. The axial forces which act on the side walls of the rotor slot in the case of a pair of intermediate pieces interlinked in this way are of the same magnitude as those axial forces which act on a whole intermediate piece. The horizontal cross section of the connected intermediate pieces is likewise shown, the short sides no longer being beveled with respect to the long sides but being at right angles to them. This shape can be produced in a simpler and more cost-effective manner.

The point of application of the interlocking forces in the interlinking, as indicated by arrows, preferably lies on the longitudinal axis 11, depicted by a broken line, of the halved intermediate piece.

The position of the interlinking or interlocking of the half pieces 7*a* and 7*b* is selected to be as far away as possible from the groove-serration bearing points 10. This is intended to ensure that connecting forces which are as small as possible are produced during operation. The point of application of the interlocking forces therefore preferably lies in the top fifth of the overall height H of the component of the intermediate piece.

Shown in FIG. 3*b* are halved intermediate pieces with a wedge-like hook shape 9, which are interlinked in a similar manner as in FIG. 3*a*. The interlinking again produces similar axial forces, so that the basic shape is the same as in FIG. 3*a*.

FIG. 3*c* shows a further embodiment with a zigzag hook shape 9. Further, curved hook shapes, for example, can also be made.

What is claimed is:

1. Intermediate pieces for filling a residual gap between moving blade roots when fastening moving blades in a rotor of a fluid flow machine, the intermediate pieces comprising: a first half member and a second half member, each of the half members having an inner side edge extending longitudinally of the member, the edge on the respective half members being in the shape of a hook, whereby the shape of the half members interlocks the members together in response to axial forces on the members.

2. The intermediate pieces as claimed in claim 1, wherein the horizontal cross section of the intermediate pieces is rectangular.

3. The intermediate pieces as claimed in claim 2, wherein the hook shape on the inner side edge of the halved intermediate pieces is of right-angled, wedge-like or zigzag shape.

4. The intermediate pieces as claimed in claim 3, wherein the point of application of the interlocking forces on the hook shapes of the intermediate pieces is located in the top fifth of the overall height (H) of the intermediate pieces.

5. The intermediate pieces as claimed in claim 3, wherein the point of application of the interlocking forces on the hook shapes of the intermediate pieces is located on the longitudinal axis (11) of the intermediate pieces.

6. The intermediate pieces as claimed in claim 1, wherein the first half member has a shape that is the mirror image of the second half member.

* * * * *